US009367041B2

(12) United States Patent
Peters et al.

(10) Patent No.: US 9,367,041 B2
(45) Date of Patent: Jun. 14, 2016

(54) METHOD FOR DISPLAYING A TREND OVER A TIMING OPERATION AND ASSOCIATED TIMEPIECE

(71) Applicant: ETA SA Manufacture Horlogere Suisse, Grenchen (CH)

(72) Inventors: Jean-Bernard Peters, Pieterlen (CH); Stephane Rychen, Bern (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/532,119

(22) Filed: Nov. 4, 2014

(65) Prior Publication Data

US 2015/0153712 A1 Jun. 4, 2015

(30) Foreign Application Priority Data

Dec. 3, 2013 (EP) ..... 13195537

(51) Int. Cl.

| | |
|---|---|
| ***G04F 8/00*** | (2006.01) |
| ***G04C 23/06*** | (2006.01) |
| ***G04C 17/00*** | (2006.01) |
| ***G04C 19/04*** | (2006.01) |
| ***G04F 3/08*** | (2006.01) |

(52) U.S. Cl.

CPC ..... *G04C 23/06* (2013.01); *G04C 17/005* (2013.01); *G04C 19/04* (2013.01); *G04F 3/08* (2013.01); *G04F 8/00* (2013.01); *G04F 8/003* (2013.01)

(58) Field of Classification Search

CPC ..... G04F 1/00; G07C 1/22
USPC ..... 368/108, 96
See application file for complete search history.

(56) References Cited

U.S. PATENT DOCUMENTS

| | | | | |
|---|---|---|---|---|
| 3,613,354 | A * | 10/1971 | Jenny | B63C 11/32 368/281 |
| 4,681,463 | A * | 7/1987 | Bendit | 368/96 |
| 5,216,641 | A * | 6/1993 | Hoel | 368/10 |
| 5,222,053 | A | 6/1993 | Ohhira | |
| 5,357,487 | A * | 10/1994 | Coleman, III | 368/10 |
| 5,386,990 | A * | 2/1995 | Smith | 473/131 |
| 5,523,985 | A * | 6/1996 | Nixon | 368/107 |
| 5,894,457 | A | 4/1999 | Lueth | |
| 6,033,316 | A * | 3/2000 | Nixon | 473/131 |
| 7,057,976 | B2 * | 6/2006 | Berseth | A63B 1/0605 368/10 |
| 7,457,201 | B2 * | 11/2008 | Jaermann | A63B 71/0672 235/1 B |
| 7,729,206 | B2 * | 6/2010 | Gordon | G04G 15/006 368/109 |
| 2001/0006489 | A1 * | 7/2001 | Gaffney | 368/10 |
| 2004/0218472 | A1 * | 11/2004 | Narayanaswami | G04G 9/02 368/10 |
| 2006/0034160 | A1 * | 2/2006 | Berseth et al. | 368/223 |
| 2007/0147174 | A1 * | 6/2007 | Jaermann et al. | 368/10 |

FOREIGN PATENT DOCUMENTS

EP 0 389 440 A1 9/1990

OTHER PUBLICATIONS

European Search Report issued Jun. 13, 2014 in European Application 13195537, filed on Dec. 3, 2013 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Portable timepiece including an hour hand and a minute hand for the current time display, rotating about a central wheel facing a bezel, and also a chronograph module, wherein the timepiece further includes a first analogue trend indicator relating to a measured time interval.

13 Claims, 2 Drawing Sheets

METHOD FOR DISPLAYING A TREND OVER A TIMING OPERATION AND ASSOCIATED TIMEPIECE

This application claims priority from European Patent application No. 13195537.9 filed on Dec. 3, 2013, the entire disclosure of which is hereby incorporated herein by reference.

The invention concerns a control and display method for a portable time measuring device, and more specifically for an electromechanical chronograph.

Portable electronic chronographs with a digital display have been used for a very long time in sports activities to indicate the performance achieved to athletes or their coaches. However, because of the digital nature of the display, these chronographs do not allow for very intuitive reading of recorded times, especially as regards visualising differences, since there is no notion of range of motion as is the case, for example, with hands.

Further, chronographs with hands are well known in the field of mechanical horology for measuring time intervals, generally with a precision of up to a tenth of a second. A sweep-second hand is started and then stopped by a push button, and the measured time interval is read on the bezel for the seconds, and on other counters for other units of time (for example the minutes, the hours or fractions of a second). A drawback of this type of chronograph is that it allows only to measure successive time intervals, or even an overall cumulative time interval; it is therefore impossible to visualise several measured times simultaneously.

There are also known watches which integrate elapsed time or remaining time display functions relating to pre-programmed events, such as, for example, the watch of EP Patent No 1807738 which was devised for astronauts making space flights. The remaining time before a given future event is thus shown as a negative indication, and the elapsed time with respect to a past event is shown as a positive indication. This multi-function watch thus makes it possible to programme and to visualise several countdowns simultaneously, with respect to predefined events, but is not, however, arranged to measure or to compare fixed time intervals like a standard chronograph. Further, the digital display of time values does not provide an intuitive representation of the magnitude of time intervals.

There is therefore a need for methods and devices for the display of measured time which are free of these known limitations.

In particular, it is an object of the present invention to provide a display method and device for a portable apparatus which is more user-friendly and more easily enables the user to visualise and compare time intervals.

These objects are accomplished by a control and display method for a portable chronograph which includes the characteristics of the main method claim 1, and a portable timepiece, such as a wristwatch, which includes the characteristics of the main device claim 7. Advantageous embodiments are defined in the dependent claims.

An advantage of the present invention is that it enables differences between measured time intervals and target intervals to be represented in a legible manner, and therefore facilitates the reading of said differences in real time. More specifically, the relative nature of such differences can be displayed in a very intuitive manner.

Another advantage of the present invention is that it proposes a new relevant performance indicator for timed trials, allowing athletes easy access to additional information which supplements their race "dashboard" and provides an effective method of monitoring performance in comparison to a prepared plan.

Example implementations of the invention are given in the description and illustrated in the annexed Figures, in which.

Figure 1:
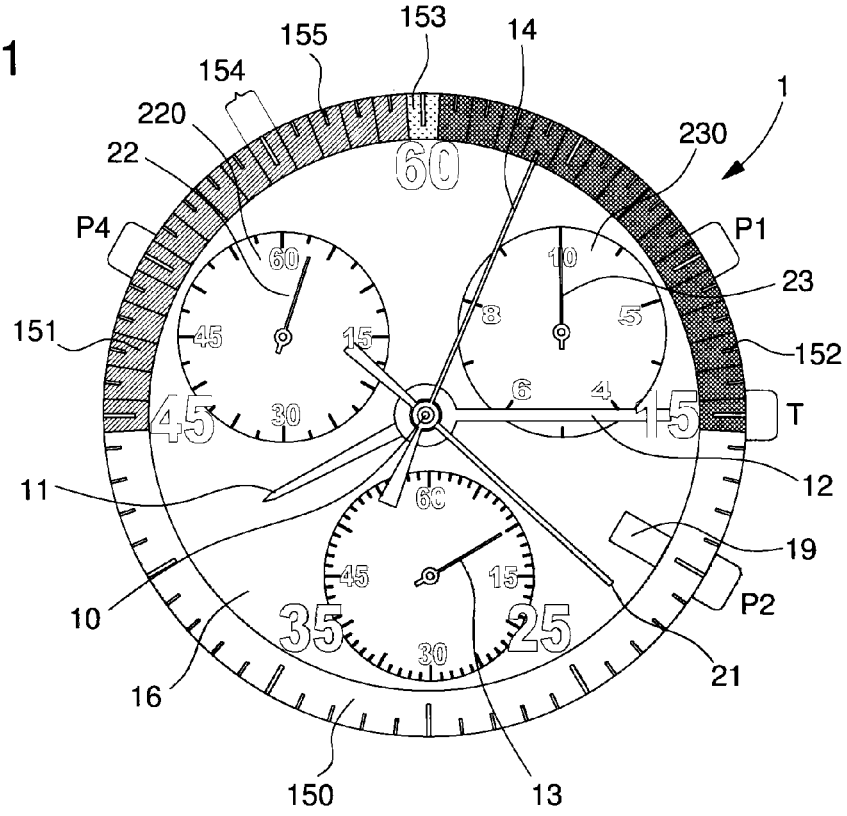
FIG. 1 illustrates a portable watch provided with a trend indicator according to a first preferred embodiment of the invention.

FIG. 1 shows a wristwatch 1 provided with an analogue trend indicator 14 according to a preferred embodiment of the invention, wherein it consists of an additional hand rotating about the central wheel 10 of the hour hand 11 and of a minute hand 11 of the movement. Wristwatch 1 includes a dial 16, surmounted by a bezel 150 provided with a series of graduations 155 over the entire periphery thereof so as to facilitate the current time reading, and on which an aperture 19 is arranged at 4 o'clock for the date display. Further, three push-pieces P1, P2 and P4 projecting outside the case middle are provided for performing time measurements and setting operations, particularly for setting reference time intervals for the measurements, as explained hereafter with reference to the following FIG. 2. A control stem T is also provided for setting the current time and for determining different operating modes. The stem is preferably axially movable into at least 3 distinct positions, one of which corresponds to a setting mode for the analogue trend indicator 14 and another to the setting of the current time. Three small hands are arranged above dial 16 facing three associated counters: at six o'clock, the small seconds hand 13 of the current time; at two o'clock, the tenths of a second hand 23 of the tenths of a second counter 230 of the chronograph module; and at 10 o'clock, the minute counter hand 22 of the minute counter 220 of the chronograph module. The seconds counter hand 21 of the chronograph module is also arranged in a conventional manner to rotate about central hour wheel 10. The arrangement proposed also enables the analogue trend indicator 14 to be added to a conventional portable watch without requiring modification of the display structure usually employed for a chronograph.

On the circular bezel 150 are disposed at least two distinct display segments, on either side of midday, i.e.: a first display segment 151 representing a delay with respect to a predefined time interval, a second display segment 152 representing an advance with respect to the same predefined time interval. This arrangement is particularly intuitive for instantaneous reading, since the midday position of a watch—at the location of the graduation "60" in FIG. 1—is generally interpreted as the time reference, and chosen as the rest position of the seconds counter hand 21 of the chronograph. This position will therefore also preferably be chosen as the rest position for the additional hand selected as the first analogue trend indicator 14, which will intuitively allow the user of the watch to visualise any delay and advance with respect to this usual reference which is attributed a neutral value.

Bezel 150 further includes a third display segment 153 arranged around midday, which is intended to indicate the precise correspondence between a predefined time and the time measured with the aid of the chronograph module. For this reason, this third angular segment is preferably very restricted in comparison to the other segments, which extend, in FIG. 1, respectively from 9 o'clock to midday and from midday to 3 o'clock, namely each over approximately 90 degrees. To accentuate the intuitive nature of the trend display, different patterns or colours could be chosen for each of the display segments, for example red for delay and green for advance, and the third display segment 153 could be matched at midday with the trend hand, by giving them, for example, the same colour (blue, yellow) or, alternatively or additionally, a corresponding pattern, such as a triangle pointing downwards at midday and a triangle pointing upwards at the end of the first trend indicator.

According to the preferred embodiment illustrated, each of the three display segments 151, 152, 153 includes a reading scale formed of blocks 154 which are superposed on the series of graduations 155 of the bezel. The third segment 153 at midday is preferably only formed of one block 154 which causes the midday graduation to stand out from its surroundings, and the same is true for each of the other blocks with respect to the other graduations of bezel 150 on the angular trend display sector, which extends here over 180 degrees, which is preferably the maximum angular range. The reading scale is consequently perfectly homogeneous and advantageously means that some existing elements of a watch can be re-used, such as a conventional bezel 150 provided with a series of graduations over the entire periphery thereof to facilitate the reading of the current time.

According to the preferred embodiment of FIG. 1, the additional hand chosen as the first analogue trend indicator 14 extends slightly further than the seconds counter hand 21 of the chronograph module so as to point directly to reading blocks 154 and so that the two hands cannot be confused. According to an alternative embodiment, a reading scale could however be arranged facing the end of the analogue trend indicator 14 on a flange or at the periphery of the dial 16, so that, if the watch also includes a graduated bezel 150, the reading of information relating to a trend over a timing operation can be completely disassociated from information relating to the current time.

Figure 2:
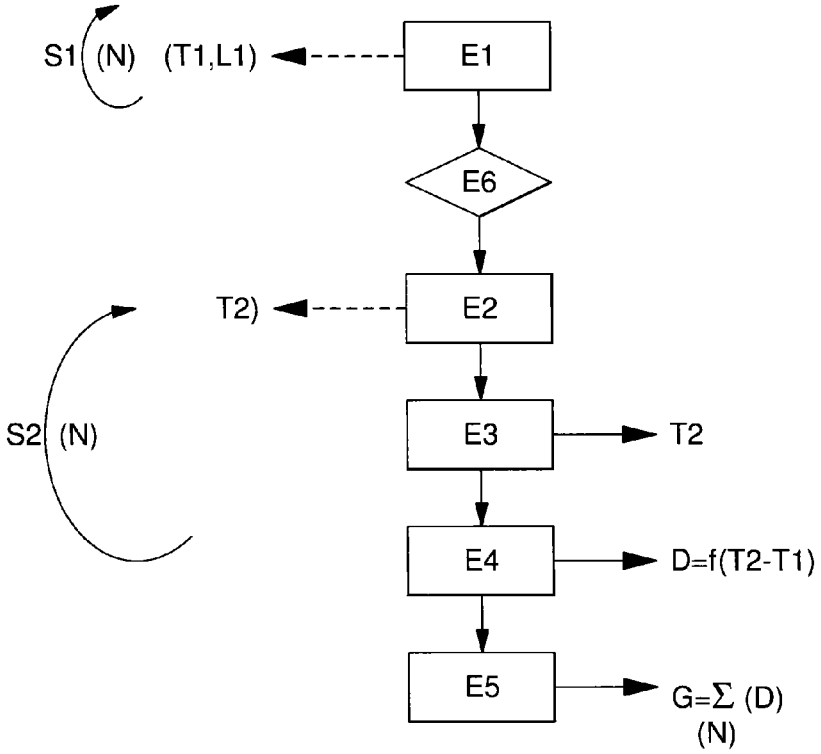
FIG. 2 shows a diagram of the various steps of a control and display method according to a preferred embodiment of the invention.

FIG. 2 illustrates a flow diagram of the sequences of steps which may be employed to programme one or more target time intervals and then to measure one or more time intervals and subsequently display the resulting differences. In the description below, reference will made to both FIG. 1 and FIG. 2 to explain a preferred embodiment of a watch which contains only one analogue trend indicator and wherein the measurement of time intervals is totally manual, i.e. started and stopped by pressing on one of the push-pieces, and then to both FIG. 2 and FIG. 3 for another preferred embodiment wherein the watch contains two distinct analogue trend indicators, for indicating absolute or relative differences respectively over one measuring step and over a sequence of measuring steps, and wherein the measurement of time intervals is partially automatic, i.e. preferably started by pressing on a push-piece, but stopped without requiring any further manual intervention by the user.

A first step E1, which relates to the programming of a predefined time interval T1, is illustrated at the top of FIG. 2. When using a portable watch as illustrated in FIG. 1, this first programming step may consist of the following sequence for each predefined time interval T1 to be programmed:

(i) pressing on the third push-piece P4 to enter in a setting mode;

(ii) pressing on first push-piece P1 to select the time parameter to be set, which may be determined in a predefined order, such as for example, first of all the minutes, then the seconds, then the tenths of a second;

(iii) pressing on second push-piece P2 to actually set the selected time parameter;

(iv) pressing briefly on the third push-piece P4 to validate the time value selected with the aid of second push-piece P2;

repeating steps (ii) to (iv) to set and validate each of the time parameters of the first predefined time interval T1;

and finally a long application of pressure on third push-piece P4, for example for at least a few seconds, to exit the setting mode.

This sequence of steps is sufficient when only one predefined time interval is required to be programmed, for example for training on an athletics track and measuring track times in comparison to reference times programmed for each lap. However, it may also be desirable to programme several distinct predefined time intervals corresponding to different portions of a race, such as for example different portions of a popular run or a cycle race against time having a race profile with differences in altitude (flat, ascent, descent) and/or very different distances. To accomplish this, instead of exiting the setting mode by a long application of pressure on third push-piece P4, the first analogue trend indicator 14 could be incremented by one unit on graduations 155 of bezel 150 and indicate the change to the setting of a second predefined time interval T1 once all the possible time parameters have been set. The same sequence of steps (ii) to (iv) described above could then be repeated, and so on for each of the predefined time intervals T1 that are required to be programmed.

As indicated on the left of FIG. 2, the first programming sequence S1 of predefined time intervals T1 may therefore include a number of iterations N corresponding to the number of steps to be programmed, i.e. the number of distinct predefined time intervals T1.

Figure 3:
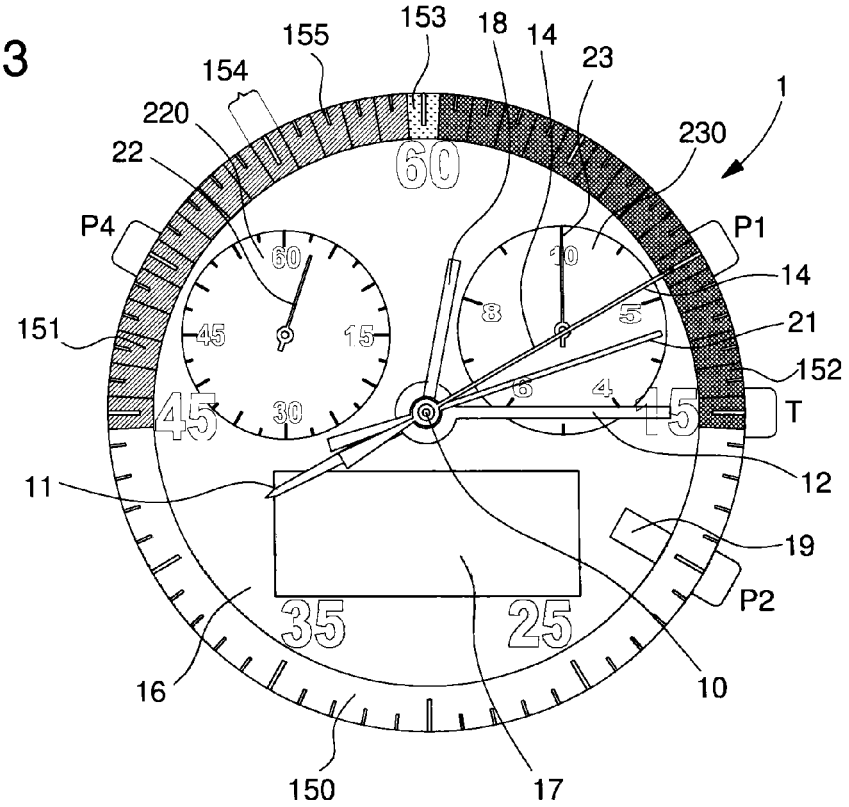
FIG. 3 illustrates a portable watch provided with two trend indicators and a digital display device, according to a second preferred embodiment of the invention.
Figure 4:
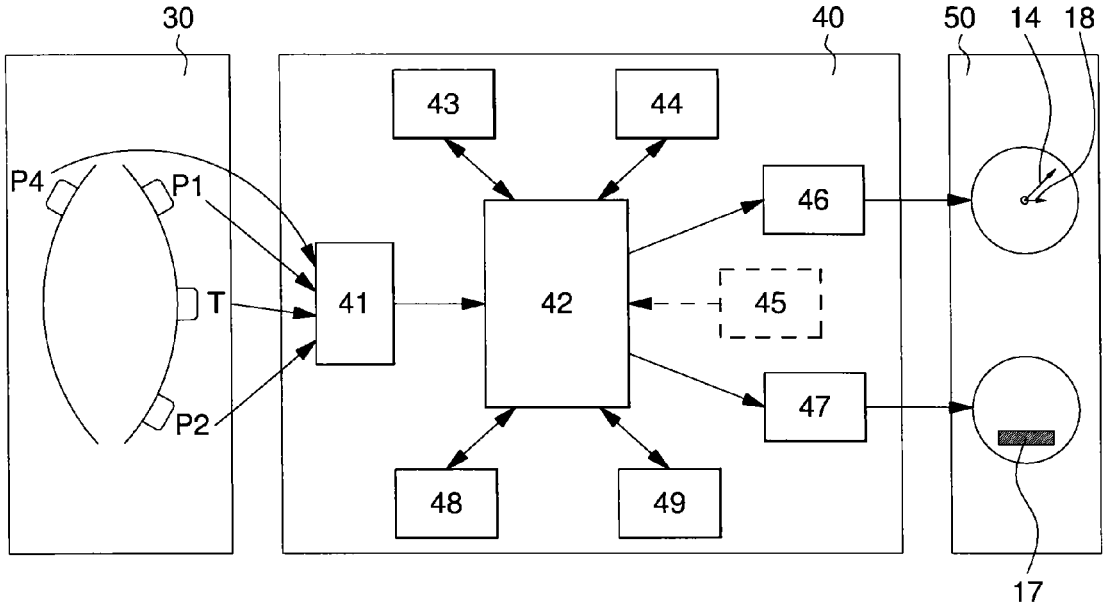
FIG. 4 shows a block diagram of a portable watch for the implementation of the method according to the preferred embodiment of the invention illustrated in FIG. 2, and which is also compatible, in particular, with the portable watch according to the embodiment of FIG. 3.

According to another preferred embodiment of the invention which does not use the portable watch 1 illustrated in FIG. 1, but a portable watch illustrated in FIG. 3, preferably including a GPS module 49—only illustrated in the block diagram of FIG. 4—which can automatically detect a change to predetermined geographical locations. Such a module is particularly advantageous for mountain races, particularly ski races, such as, for example, the Patrouille des Glaciers mountaineering race in Switzerland, where meteorological conditions require gloves to be worn and thus prevent easy manipulation of push-pieces. In that case, the programming of each predefined time interval T1 must be associated with a corresponding location L1, which will have to be accomplished during an additional programming step following each last validation step (iv) of the last possible time parameter of a given predefined time interval T1. Assuming that a specific GPS programming mode has already been actuated, for example by a long application of pressure on third push-piece P4 instead of a short application pressure on the same third push-piece P4, it will then be necessary to adjust the GPS coordinates after having set each predefined time interval T1, for example with the aid of an additional sequence of setting steps similar to those of steps (ii) to (iv) described above, namely:

pressing on first push-piece P1 to determine the GPS parameter to be set, then setting the GPS parameter with the aid of second push-piece P2, and finally validating this parameter with the aid of third push-piece P4, until all the possible GPS coordinates have been entered and validated. As soon as this has been accomplished, as previously, one may choose either to continue to programme predefined time intervals T1 and the additional corresponding geographical locations by a short application of pressure on third push-piece P4 when the last GPS parameter is validated, or to exit the setting mode by a long application of pressure on third push-piece P4.

Once this first programming sequence S1 has been completed, one could choose to set the trend display, in optional setting step E6, by selecting the granularity of the scale used facing the hand forming the first analogue trend indicator. Indeed, although it is possible to envisage displaying absolute time differences, i.e. corresponding to an actual time value, within the scope of the present invention, preference will be given to a relative trend display, i.e. differences corresponding to a percentage of the predefined time intervals T1 which have been programmed. According to the preferred embodiments illustrated in FIGS. 1 and 3, it can be observed that each of the display segments relating to advance and delay includes 15 units, which means that the percentage linked to the relative difference is at most 15%. The setting step would make it possible to attribute a multiple integer to these unit values, to raise the maximum percentage to, for example, 30 or 45%. This is accomplished by entering in a setting mode, for example by changing the axial position of stem T, by pulling it one notch outwards. In this axial position of stem T, an application of pressure on third push-piece P4 can increment, for example by successive applications of pressure on first push-piece P1 or second push-piece P2, the value read on graduations 155 of bezel 150 facing the first analogue trend indicator 14, the incrementation value being one unit for each successive pressure on the push-piece and determining the multiplicative factor. Thus, a first application of pressure would correspond to the normal mode—i.e. with a multiplicative factor of 1—a second application of pressure would mean a multiplicative factor of 2, a third application of pressure a multiplicative factor of 3, etc. . . . . The multiplicative factor is generally limited to a maximum of 5, which would mean that the range of relative differences displayed would be comprised between −75 and +75% of the predefined programmed time intervals T1.

Once the optional setting step E6 has been performed, a second sequence S2 may be performed, having a number N of iterations, equal to the number of iterations N of the first programming sequence S1 for the various predefined time intervals T1. Sequence S2 includes the following series of steps:

- a second measurement step E2 of a second time interval T2, intended to correspond to the first programmed predefined time interval T1, then
- a third step E3 of displaying this second time interval T2, followed by a
- fourth step E4 of displaying a difference D between the first predefined time interval T1 and the second time interval T2 by means of the first analogue trend indicator 14. As indicated above, the difference D displayed may be an absolute difference or a relative difference. According to the preferred embodiment of the invention illustrated in FIG. 1, the additional hand used as first analogue trend indicator 14 is coaxial with and of a similar length to the hand of the chronograph seconds counter 21 and preferably measures an absolute difference in seconds only; consequently the display of a relative difference D as a percentage of the first predefined time interval T1 will be preferred. In other words, the function f(T2−T1) determining difference D will preferably be equal to (T2−T1)/T1.

According to a preferred embodiment, the measurement of time intervals will be started by pressing on first push-piece P1, while for each of the second time interval steps E2, push-piece P2 will be pressed, which will stop the chronograph while continuing to count the time that has elapsed since the start. After the fourth step of displaying difference D, first analogue trend indicator 14 can therefore be reset to zero for each following step, whereas the chronograph display will turn back, preferably after a few seconds, to a display value of the elapsed time since the start of the measurement.

To stop the chronograph, i.e. both to end a measurement step and to stop the elapsed time since the start of the series of measuring steps, first push-piece P1 is preferably pressed. According to a preferred embodiment of the invention, at the end of second sequence S2, i.e. after the fourth step E4 of displaying difference D of the last measuring step, a fifth display step E5 displays an overall difference G across all of the measuring steps, i.e. throughout the entire elapsed time. Overall difference G is therefore equal to the sum of differences D over the number N of measurement iterations. To accomplish this, if a watch with a single trend indicator like the watch illustrated in FIG. 1 is used, the difference D of the last measurement step could first be displayed by means of first analogue trend indicator hand 14 and then, preferably after a few seconds, the same hand could return to the display of overall difference G.

FIG. 3 illustrates another preferred embodiment of the invention which uses distinct dedicated indicators to display simultaneously, and not alternatively, the trend over the timing of each of the measuring steps, when there are several, and the overall trend at the end of the series of measuring steps, during the fifth display step E5. In order to simultaneously, rather than alternatively, display two pieces of information relating to the same trend parameter, i.e. difference D corresponding to a specific step, and overall difference G, a second analogue trend indicator 18 is used in addition to first analogue trend indicator 14. This second analogue trend indicator 18 indicates the overall, preferably relative difference G between a first sum of first predefined time intervals T1 and a second sum of said second measured time intervals T2, for a number N of measurement iterations. According to the preferred embodiment illustrated in FIG. 3, the second analogue trend indicator 18 is mounted coaxially to first analogue trend indicator 14 about the same central wheel 10 of the hands of the movement, so that the display values can be read facing the same scale of the first, second and third display segments 151, 152 and 153 used by first analogue trend indicator 14, and so that only one additional motor, but no additional space is required on the bezel. Such an arrangement also facilitates the intuitiveness of the comparison between the two pieces of information displayed simultaneously on a common scale. This second indicator, of shorter length, substantially equal to that of hour hand 11 of the movement, will also be arranged always to be superposed on the first indicator except when it indicates an overall, preferably relative difference G over a sum of first time intervals T1.

It may be noted that the only other difference between the preferred embodiment illustrated in FIG. 3 and that of FIG. 1, apart from the addition of second analogue trend indicator 18, concerns the omission of the small seconds hand 13 at six o'clock on dial 16 and the replacement thereof with a digital display module 17, such as, for example, an LCD type display. This digital display module 17 is used, in particular, for entering GPS coordinates corresponding to predefined locations L1 respectively associated with the first predefined time intervals T1, as explained above with reference to FIG. 2. This digital display module 17 may also provide additional information relating to the number of the current programming step, additionally or alternatively to positioning a hand indicating the current programming step number—like the incrementation of first analogue trend indicator 14 by one unit described above for a change from setting a first predefined time interval T1 to a subsequent interval in a first programming sequence S1.

Aside from these differences, all the references of FIG. 3 are identical to those of FIG. 1, and will consequently not be described again.

FIG. 4 illustrates a block diagram of a portable electronic watch according to a preferred embodiment of the invention, subdivided into three blocks for the display of the trend over a timing operation:

a control interface 30 formed by first push-piece P1, second push-piece P2, third push-piece P4 and stem T;

a display module 50, including both the analogue indicators, i.e. first analogue trend indicator 14 and second analogue trend indicator 18, and the digital module 17 used during the programming sequences;

and an electronic control circuit 40.

Electronic circuit 40 preferably includes a sensor module 41—to which a counter module may be slaved—for detecting and counting applications of pressure on the various push-pieces, and a controller circuit 42, including, for example, a microcontroller, linked on the one hand to a time dividing circuit connected to a resonator to provide a time base 45, and on the other hand to a first motor control circuit 46 for the analogue display members and a second control circuit 47 for the LCD screen of digital display module 17. Controller circuit 42 receives signals from sensor module 41 for navigation and setting in different menus; it is also connected to a first flash or SSD memory area 43 allowing the circuit to perform relative or absolute difference calculations, during the time interval measurement sequences, and a second memory area 44, provided for storing the time and possibly location parameters (i.e. the values of predefined time intervals T1 and the coordinates of the corresponding locations L1).

Finally, electronic circuit 40 preferably includes two modules connected to controller circuit 42 which are provided for the automatic detection of time measurement, namely a transponder module 48, for example of the RFID type, and a GPS module 49. Due to the high energy consumption of each of these modules, particularly of GPS module 49, they could be arranged in a removable manner in the watch case or be actuated on demand, given that it is preferable to only be able to actuate one of these two modules alternately, but never both at once, for the time interval measurement, or to combine them with manual measuring methods using push-pieces for intermediate times. The advantage of these two modules is that no pressure is required for stopping the chronograph. While transponder module 48 has the relative advantage, compared to the GPS module, of using considerably less energy, this module can nonetheless only be used, a priori, in a race where transponder detection devices have already been installed for intermediate times. Thus, transponder module 48 could not be used, for example, for performing a reconnaissance trip or for planning a training session, but only for displaying race performances in real time.

Preferably, a series of time interval measurements can include up to around 20 measurements, and after each measurement, started by an application of pressure on first push-piece P1 and stopped by a second application of pressure on second push-piece P2—or alternatively by detection of a terminal by transponder module 48 or the matching of geographical coordinates by GPS module 49,—controller circuit 42 sends actuation signals to motor control circuit 46 to move analogue trend indicator 14 away from its rest position at midday on dial 16 visible in FIG. 3, to a position facing the calculated value. Until the last measurement, preferably determined by an application of pressure on push-piece P1, regardless of the detection mode, i.e. manual or automatic, chosen for intermediate time measurements, the second analogue trend indicator 18 is also positioned by motor control circuit 46 on the same value as first analogue trend indicator 14, so as not to hinder readability for the user by overloading the dial with diverse angular positions of a plurality of separate hands. The two analogue trend indicators are thus potentially only separated after the last measurement.

Those skilled in the art will understand that the various preferred embodiments described in the above description, are given solely by way of example and are not intended to be interpreted in a limiting manner. Thus, other types of analogue indicators, of the cursor or possibly even linear type, can also be envisaged without departing from the scope of the present invention.

Further, it will also be understood that it is possible to combine all or part of the characteristics described in the various FIGS. 1 to 4, and particularly that it is possible to use a portable watch 1 according to the embodiment illustrated in FIG. 1, and which uses an RFID module 48, but not a GPS module 49, or a watch provided with an RFID module 48 and a GPS module 49, but which only uses one hand for the trend display, whether or not it is an overall trend.

What is claimed is:

1. A control or display method for a portable timepiece including a display to display a measured time and at least a first analogue trend indicator, a control interface, and an electronic circuit for the actuation of said analogue trend indicator, wherein the method comprises:

programming a first predefined time interval;

measuring a second time interval;

displaying said second time interval; and displaying a positive or negative relative difference, which is equal to a result of taking a difference between said first predefined time interval and said second time interval and dividing said difference by said first predefined time interval, with aid of said first analogue trend indicator.

2. The control or display method according to claim 1, wherein said programming is performed manually whereas said measuring is at least partially automatic, performed by a transponder module or a GPS module.

3. The control or display method according to claim 2, wherein said manual programming a first time interval is correlated with the manual programming of a predefined geographical location.

4. The control or display method according to claim 1, wherein the method includes a first programming sequence of a number higher than 1 of said programming of distinct first predefined time intervals, a second sequence of said number of measuring of distinct second time intervals, wherein the method includes displaying, at the end of said second sequence, an overall difference between the sum of said first predefined time intervals of said first sequence and the sum of said second time intervals of the second sequence in analogue form.

5. The control or display method according to claim 1, wherein the method includes a subsidiary setting of a difference display.

6. A portable timepiece for implementation of the control or display method of claim 1, including an hour hand and a minute hand for current time display, rotating about a central wheel, and also a chronograph module, wherein the chronograph module further includes the first analogue trend indicator configured to display the positive or negative relative difference, which is equal to the result of taking the difference between the first predefined time interval and the second measured time interval and dividing said difference by said first predefined time interval.

7. The portable timepiece according to claim 6, wherein the timepiece includes a second analogue trend indicator distinct from said first analogue trend indicator, configured to indicate a difference between a first sum of said first predefined time intervals and a second sum of said second measured time intervals.

8. The control or display method according to claim 1, wherein said first analogue trend indicator includes a rotatable hand, and the displaying the positive or negative relative difference includes displaying the positive or negative relative difference with the rotatable hand.

9. A portable timepiece for implementation of a control or display method for the timepiece that includes a display to display a measured time and at least a first analogue trend indicator, a control interface, and an electronic circuit for the actuation of said analogue trend indicator, wherein the method includes programming a first predefined time interval, measuring a second time interval, displaying said second time interval, and displaying a positive or negative difference between said first predefined time interval and said second time interval, with aid of said first analogue trend indicator, the timepiece comprising:

an hour hand and a minute hand for current time display, rotating about a central wheel, and also a chronograph module, wherein the chronograph module further includes the first analogue trend indicator configured to display the positive or negative difference between the first predefined time interval and the second measured time interval, wherein said analogue trend indicator is an additional hand rotatably mounted about said central wheel, and moving round a bezel, said bezel also including at least a first display segment representing a delay relative to said first predefined time interval and a second display segment representing an advance relative to said first predefined time interval, said first and second display segments being located on either side of midday.

10. The timepiece according to claim 9, wherein said bezel includes a third display segment extending over a very restricted angular segment and representing a correspondence between said first predefined time interval and said second measured time interval, said third display segment being also matched with said first analogue trend indicator.

11. The portable timepiece according to claim 10, wherein said first display segment, said second display segment and said third display segment include a reading scale formed of a series of blocks extending over an angular sector of said bezel.

12. A portable timepiece for implementation of a control or display method for the timepiece that includes a display to display a measured time and at least a first analogue trend indicator, a control interface, and an electronic circuit for the actuation of said analogue trend indicator, wherein the method includes programming a first predefined time interval, measuring a second time interval, displaying said second time interval, and displaying a positive or negative difference between said first predefined time interval and said second time interval, with aid of said first analogue trend indicator, the timepiece comprising:

an hour hand and a minute hand for current time display, rotating about a central wheel, and also a chronograph module, wherein the chronograph module further includes the first analogue trend indicator configured to display the positive or negative difference between the first predefined time interval and the second measured time interval, a second analogue trend indicator distinct from said first analogue trend indicator, configured to indicate a difference between a first sum of said first predefined time intervals and a second sum of said second measured time intervals, wherein said analogue trend indicator and said second analogue trend indicator are mounted coaxially about the central wheel and configured always to be superposed, except when said second analogue trend indicator indicates an overall difference over the sum of first time intervals.

13. A portable timepiece for implementation of a control or display method for the timepiece that includes a display to display a measured time and at least a first analogue trend indicator, a control interface, and an electronic circuit for the actuation of said analogue trend indicator, wherein the method includes programming a first predefined time interval, measuring a second time interval, displaying said second time interval, and displaying a positive or negative difference between said first predefined time interval and said second time interval, with aid of said first analogue trend indicator, the timepiece comprising:

an hour hand and a minute hand for current time display, rotating about a central wheel, and also a chronograph module, wherein the chronograph module further includes the first analogue trend indicator configured to display the positive or negative difference between the first predefined time interval and the second measured time interval, wherein said analogue trend indicator is an additional hand rotatably mounted about said central wheel, and moving round a bezel, said bezel also including at least a first display segment representing a delay relative to said first predefined time interval and a second display segment representing an advance relative to said first predefined time interval, said first and second display segments being located on either side of midday, wherein said bezel includes a third display segment extending over a very restricted angular segment and representing a correspondence between said first predefined time interval and said second measured time interval, said third display segment being also matched with said first analogue trend indicator, wherein said first display segment, said second display segment and said third display segment include a reading scale formed of a series of blocks extending over an angular sector of said bezel, wherein said control interface includes three distinct pushpieces, and a stem that is axially movable into at least three distinct positions, at least one of which corresponds to a setting mode of said analogue trend indicator.

* * * * *